US010260235B1

(12) United States Patent
Nanayakkara

(10) Patent No.: US 10,260,235 B1
(45) Date of Patent: Apr. 16, 2019

(54) CONSTRUCTION METALLIC TRAPEZOIDAL SYSTEMS

(71) Applicant: Pravin Nanayakkara, Boca Raton, FL (US)

(72) Inventor: Pravin Nanayakkara, Boca Raton, FL (US)

( * ) Notice: Subject to any disclaimer, the term of this patent is extended or adjusted under 35 U.S.C. 154(b) by 0 days.

(21) Appl. No.: 15/714,694

(22) Filed: Sep. 25, 2017

(51) Int. Cl.
*E04C 3/07* (2006.01)
*E04B 1/16* (2006.01)
*E04B 1/24* (2006.01)
*E04C 3/04* (2006.01)

(52) U.S. Cl.
CPC ..... *E04C 3/07* (2013.01); *E04B 1/165* (2013.01); *E04B 1/2403* (2013.01); *E04B 2001/2415* (2013.01); *E04B 2001/2481* (2013.01); *E04C 2003/0473* (2013.01)

(58) Field of Classification Search
CPC ..... E04C 3/07; E04B 1/165; E04B 1/2403
USPC ..... 52/602
See application file for complete search history.

(56) References Cited

U.S. PATENT DOCUMENTS 4,007,570 A * 2/1977 Hunter ..... E04B 1/2403 52/317
4,685,264 A * 8/1987 Landis ..... E04B 5/40 249/28
4,982,545 A * 1/1991 Stromback ..... E04C 3/07 52/639
4,982,548 A * 1/1991 Abbey ..... E04B 1/0007 403/232.1
5,188,479 A * 2/1993 Nehls ..... E04B 1/2403 403/300
5,403,110 A * 4/1995 Sammann ..... E04B 1/5831 403/205
5,414,972 A * 5/1995 Ruiz ..... E04B 5/29 52/335
5,459,967 A * 10/1995 Bodtker ..... E04B 7/00 182/82
8,141,318 B2 * 3/2012 Dunbar ..... E04C 3/07 52/636
8,640,419 B2 * 2/2014 Lee ..... E04C 3/44 52/649.2
8,661,754 B2 * 3/2014 Hsu ..... E04B 5/40 52/289
8,910,450 B2 * 12/2014 Simon-Dominguez ..... E04G 11/44 52/742.14
9,803,351 B2 * 10/2017 Ledford ..... E04B 1/2403
2003/0089069 A1 * 5/2003 Babich ..... E04B 1/2403 52/693
2006/0265992 A1 * 11/2006 Hiragaki ..... E04B 1/2403 52/633

(Continued)

*Primary Examiner* — Paola Agudelo
(74) *Attorney, Agent, or Firm* — Melvin K. Silverman

(57) ABSTRACT

A construction system definable in terms of an X, Y, and Z coordinate axes which provides a first part having a hollow three-walled web elongate in the Z axis, having a series of rigid securement flaps on the upper Z edges of the elongate Z axis member; and a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support.

8 Claims, 9 Drawing Sheets

(56) References Cited

U.S. PATENT DOCUMENTS

2014/0165499 A1* 6/2014 Vanker ..... E04C 3/07
52/834

* cited by examiner

CONSTRUCTION METALLIC TRAPEZOIDAL SYSTEMS

BACKGROUND OF THE INVENTION

The present invention relates to metallic surfaces of trapezoids of types used within frame of residential, commercial or industrial structures, and is an improvement of the invention of my U.S. Pat. No. 6,988,347, entitled Metal Stud Frame Element.

Historically frames of such structures were formed of steel and in the case of bearing structures; it was common to use a steel bar.

The use of vertical light gauge steel and studs, in lieu accomplish internal framing within a structure is also well known in the art. It is however not known to employ thin gauge vertical surfaces in combination with exterior wall framing in which vertical studs operate to define an offset the distance between an exterior and which is secured to one surface of such a steel surface.

A need for such surface steel gauges has arisen as a consequence of rapid on-site assembly high techniques employing thin external surfaces which have developed in the construction arts. The present invention therefore relates to such vertical metallic elements in which a one rectilinear surface thereof may operate as a process of an exterior surface, its base and/or load bearing resultant.

SUMMARY OF THE INVENTION

A construction system definable in terms of an X, Y, and Z coordinate axes which provides a first part having a hollow three-walled web elongate in the Z axis, a series of rigid securement flaps on the upper edges of the elongate Z axis member and a second part having at least one open end for complemental engagement of the first part wherein the second part may fit over distal ends of said first part in which a cross-section of the second part is generally that of the first part, but wide and tall enough to allow the first part to slip within the second part, and said second part having an opposite end of said opening, wherein said second part securing the first part to a structural support.

Further provided is said series of rigid securement rigid flaps extending upwardly in a positive Y direction from said upper XZ base, wherein said rigid securement flaps on a positive X axis have a cross-section in the YX plane resembling an inverted "L", wherein the lip of the "L" extends away from the direction of the center of the member on the X axis, and said rigid flaps on a negative X have a cross-section in the YX plane resembling a mirror of an inverted "L", wherein the lip of the "L" extends away the direction of the center of the member on the X axis. Said securement flaps transfer shear force (shear flow) into the concrete it fixes to. The series of rigid securement flaps have a space between each flap, and said space between said rigid securement flaps have a lower edge at the upper Z edge of the three-walled member. Additionally, said space between said rigid securement flaps have a lower edge part of the distance between the upper Z edge of the three-walled member and the upper edge of the rigid securement flap of the three-walled member. Said space between said rigid securement flaps may be in a range of geometric shapes, including, circular, square, dovetail, rectangular, etc.

Yet further provided is, the first part having a hollow three-walled web having an open upper area and a lower XZ base along an elongate Z axis connected to two opposing walls of YZ planes.

Further provided is a series of substantially circumferential holes occurring toward the upper edges of the YZ web where said series of elements existing along the entire Z distance.

Yet further provided in the system is an XZ cross-section, which may be in the form of a trapezoid, inverted trapezoid, square, rectangle, or similar shape.

Additionally provided are possible structural supporting members attached to the lower XZ base, which may be in the form of a rod, such as a rebar, plate fastened to the surface of the base, such as a steel plate, with or without steel sidewalls, or ribs in the lower XZ base.

It is an object of the present invention to provide metallic structural elements which may be used in a vertical or horizontal capacity, including use within walls, floor, ceilings, and roofs.

It is yet another object to provide a three-walled elongate of the above type which can function as interior to exterior offsets.

It is accordingly an object of the invention to provide for both cast in place and pre-cast members to support concrete surfaces, such as a floor, roof, or wall.

It is yet another object to provide a three-walled member, capable of being rolled into shape, and cut to a desired length.

It is yet a further object to provide a multi-part system where a second part may complementally engage a first part, and allow the first part to be cut to a desired length as above.

The above and yet other objects and advantages of the invention will become apparent from the hereinafter set forth Brief Description of the Drawings, Detailed Description of the Invention, and Claims appended herewith.

DETAILED DESCRIPTION OF THE INVENTION

Figure 1:
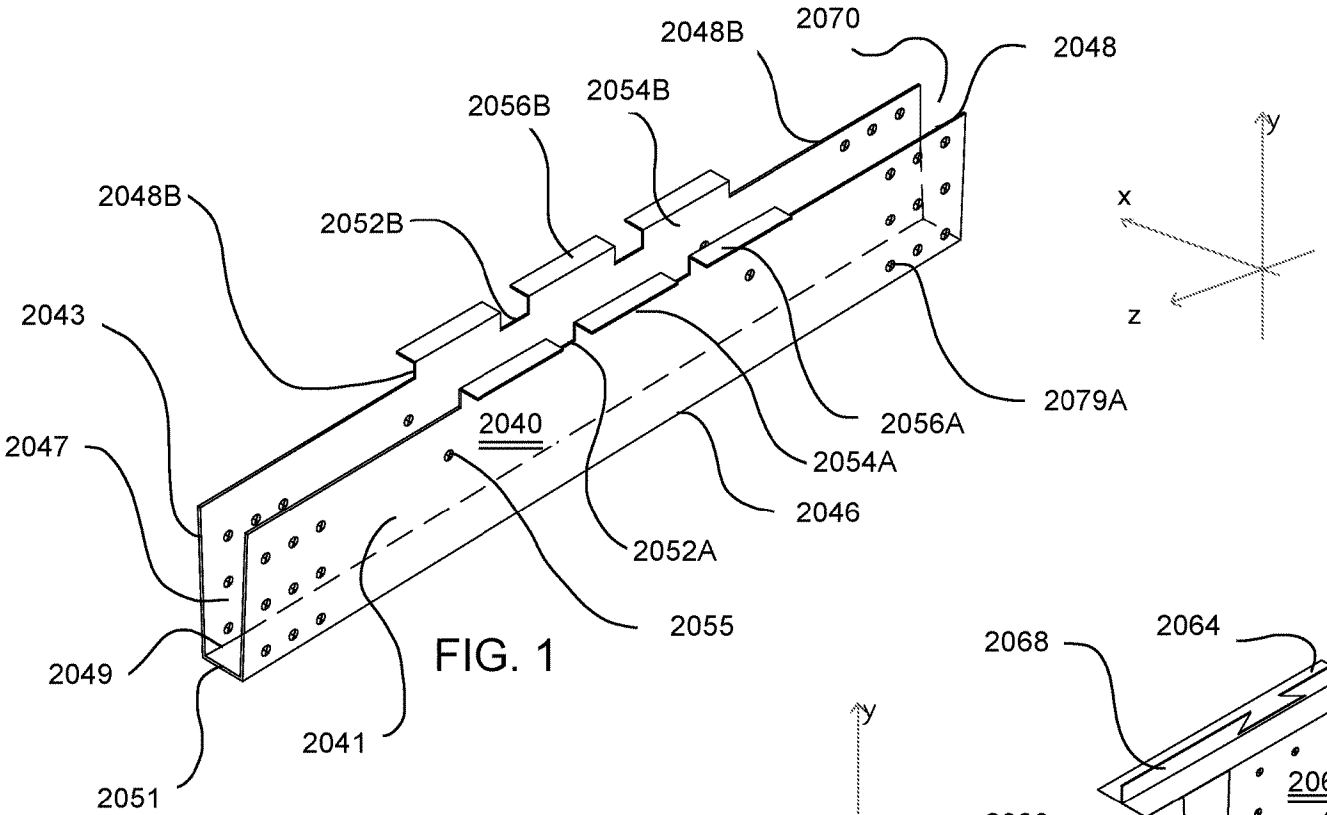
FIG. 1 is a perspective view of a first part of the system.
Figure 2:
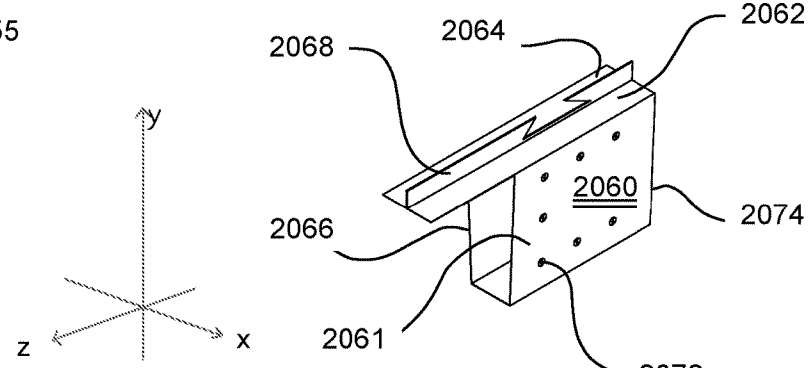
FIG. 2 is a perspective view of a second part of the system of FIG. 1.

There is provided a construction system which provides terms of an X, Y and Z coordinate system, this particularly as is shown with FIGS. 1 and 2 herewith.

Figure 16:
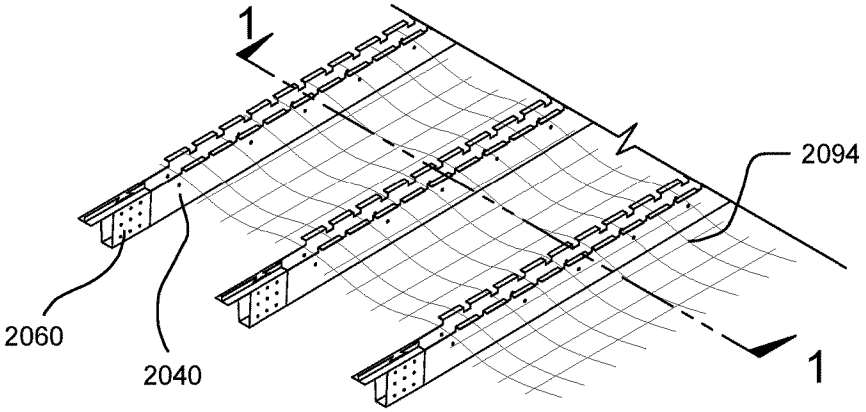
FIG. 16 is a perspective view of multiple members in the system.
Figure 17:
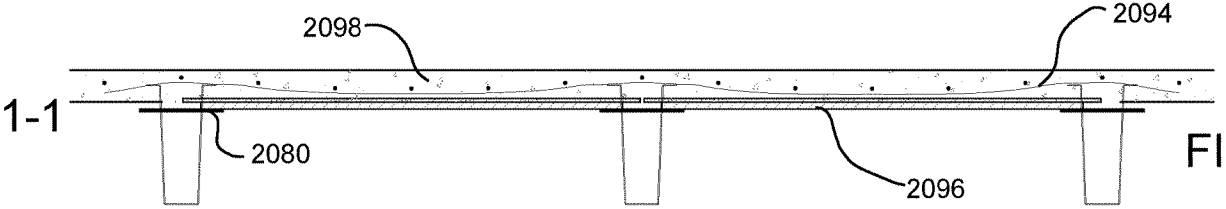
FIG. 17 is an XY cross sectional view of the system of FIG. 16 with form-board.
Figure 18:
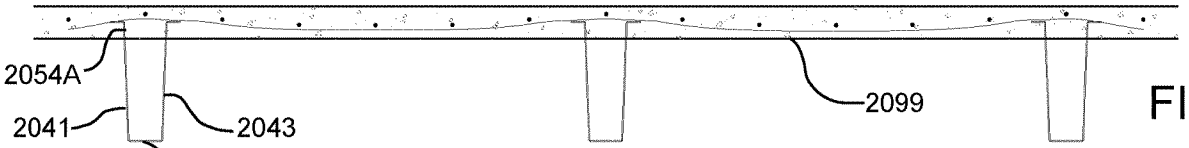
FIG. 18 is an additional XY cross sectional view of the system of FIG. 17 with form-board removed.
Figure 19:
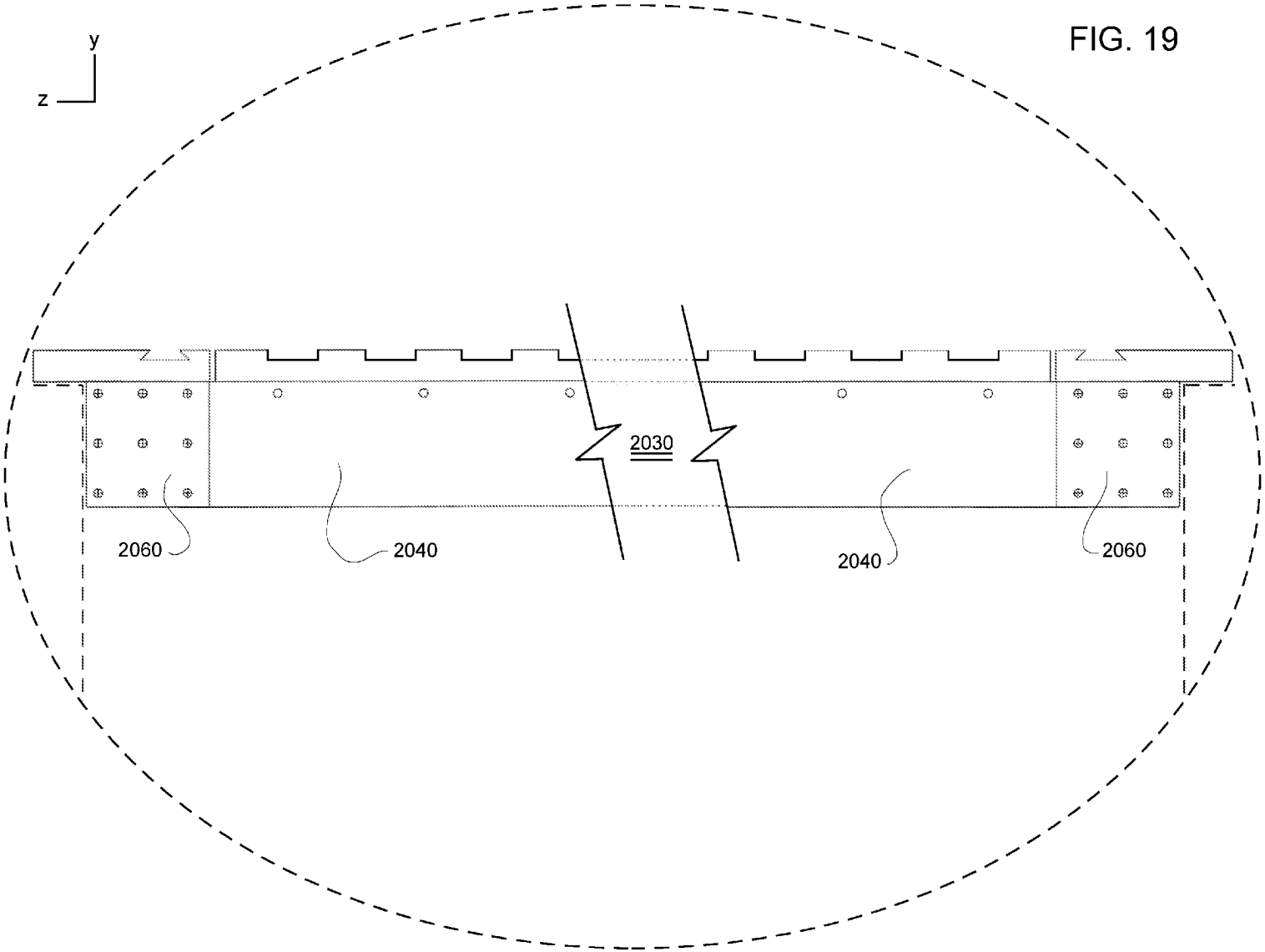
FIG. 19 is an YZ side elevation depicting the full joist of the system.

The system may be used in a horizontal orientation in use, for example, with flooring, ceilings, or roofing, and may be produced using material, such as steel, fiber glass, carbon fiber, etc. The system may also be used vertically, for example, in wall construction. One may secure the members 2040 and 2060 in use with concrete or similar material by fitting an opening 2074 of a second part of the system 2060 over a cross-sectional end 2047 of a first part of the system 2040 at each distal end, and casting the concrete in place as shown in FIGS. 16-18 over the securement flaps 2054A/2056A and 2054B/2056B. A securing member 2080, may pass through the members to hold up a material thereof supporting said concrete for cast-in-place uses as shown in FIG. 17. The system may also use pre-casting, where the members are cast upside down until the concrete hardens, then flipped over and put in to place. Said securement flaps 2054A/2056A and 2054B/2056B transfer shear force (shear flow) into the concrete it fixes to In other words, end members 2060 are placed at each end of the three-walled member. The end member 2060 allows the joists 2030, made up of the first part 2040 and second part 2060, as shown in FIG. 19, to sit on the surface of a structural support, such as a pier, beam, joist, stud, or wall. Once joist members 2030 are placed into their location, a form-work support pin 2080 is placed, and form board 2096 is placed on top of the pins. See FIG. 17. From there a wire mesh 2094 is laid on top of the form board 2096, as shown in FIGS. 16 and 17. From there, concrete 2098 is poured over top of the form board, and once hardened, the pins 2080 can be removed and the form board 2096 lowered, exposing the newly hardened concrete lower surface 2099, as seen in FIG. 18, Supported by the three-walled members.

While the present system may be used for cast in place construction as mentioned above, this embodiment is best enabled for a pre-cast system. This is because the system has an open upper XZ plane 2070, as seen in FIG. 1. In an effort to keep the concrete from filling in the member through the upper XZ plane opening 2070, the joist members 2030 of a first part 2040 and a second part 2060, are best suited to have securement flaps 2054A/2054B and 2056A/2056B secured in to concrete 2098 upside down, then flipped over into a position once the concrete is hardened, similar to FIG. 18.

In FIG. 1 is seen sidewall 2041, on a YZ plane, between edges 2046 of a lower XZ base and upper edge 2048. Edges 2046 and 2049 define the lower four-sided XZ base 2051.

Further shown in FIG. 1, is a series of substantially circumferential holes 2055 occurring toward the upper edges of the YZ web where said series of holes exist along the entire Z distance. These holes 2055 are used in the placement of a form pin 2080, which can be further seen in FIG. 17.

Figure 6:
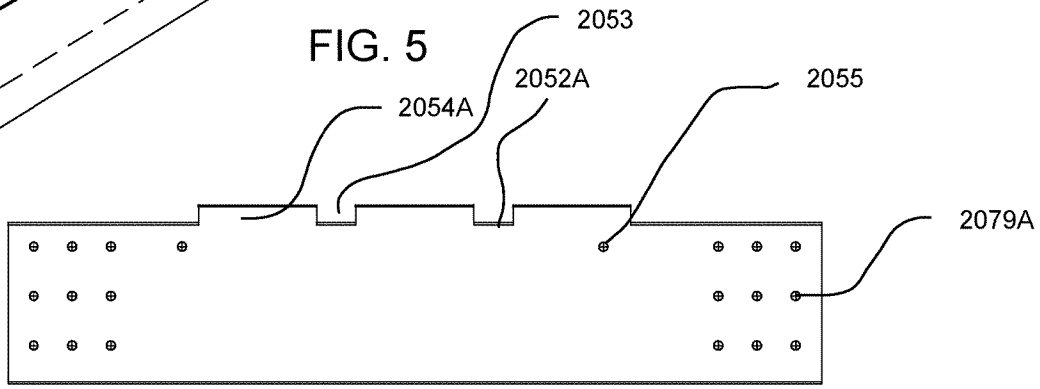
FIG. 6 is a YZ elevation view of the system in FIG. 5

An upper opening 2070 extending in a Z axis can be seen in FIGS. 1 and 6. As may also be seen in FIGS. 1 and 6, at the upper edges 2048/1048B, is a series of rigid flaps 1054A/1054B extend in the positive Y direction of the YZ walls 2041 and 2043

Figure 7:
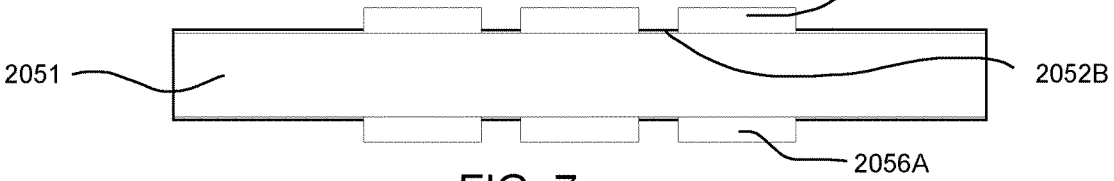
FIG. 7 is an XZ top view of the system in FIG. 5

This is further shown in FIG. 7, where the system can be seen from the top view. The structure further provides said rigid flaps having a cross-section in the YX plane, as shown in FIG. 3, rigid flaps 2054A/2056A resembling an inverted "L", or rigid flaps 2054B/2056B resembling a mirror of an inverted "L", protruding from the upper XZ edge in the positive Y direction, where the XZ lip 2056A and 2056B extends towards the X direction of the upper opening 2070 on the X axis.

In an ideal manufacture, the member 2040 will begin as a continuous solid sheet of metal, and will be rolled into for on a continuous machine, allowing members to be cut into varying lengths.

FIG. 2 is the second part of the system. The member 2060 of the second part slip-fits over the member 2040 of a first part. The member of the second part 2060 is of the same proportions of the first part with a slightly larger cross-section to allow the cross sectional opening 2047 of the first part to slide in to the opening 2074 of the second part. Sidewall 2061 of the second part abuts the outside of sidewall 2041 of the first part. Sidewall 2066 abuts sidewall 2043. Lower XZ base 2072 of the second part abuts the underside of lower XZ base 2051 of the first part. Areas for screws 2079 exist on the sidewalls if the second part of the system, and complement area 2079A on the first part of the system. Screws allow the first part of the system to fasten to the second part of the system.

Figure 3:
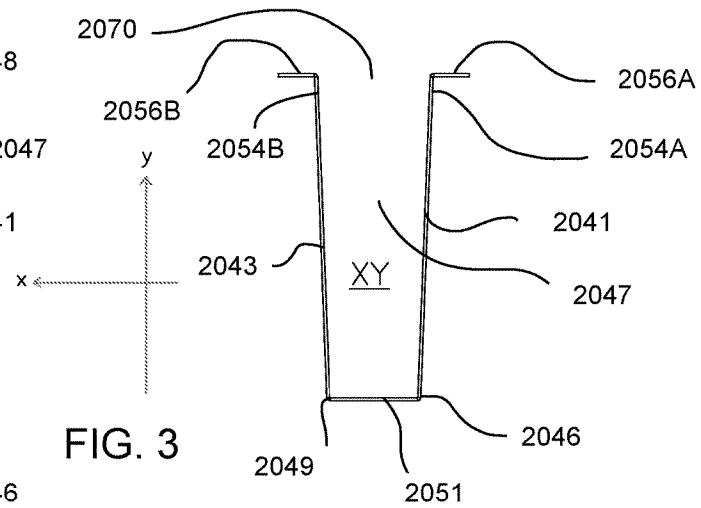
FIG. 3 is an XY cross-sectional view of FIG. 4 at 3-3
Figure 3A:
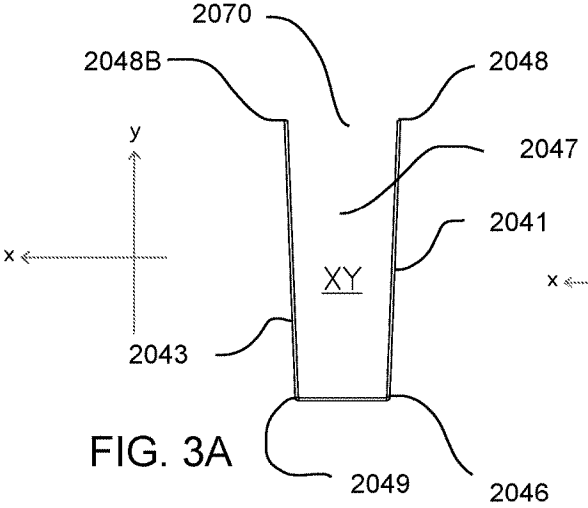
FIG. 3A is an XY cross-sectional view of FIG. 4 at 3A-3A
Figure 4:
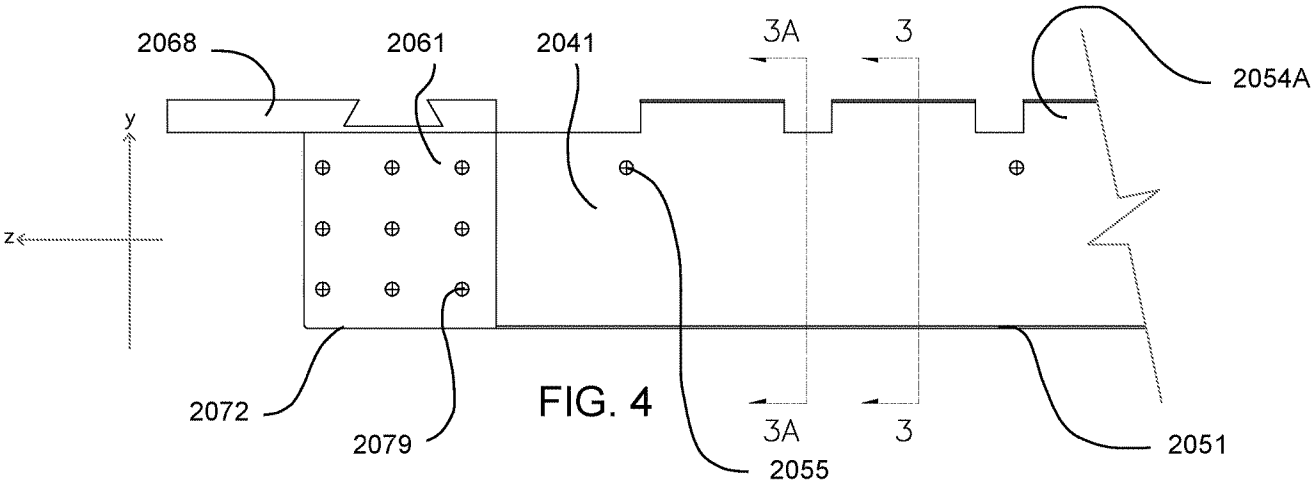
FIG. 4 is a side elevation depicting the insertion of the first part within a second part of the system.

FIGS. 3 and 3A shows a cross-sections of FIG. 4 of the first part of the member. Noticed in FIG. 3. are YZ sidewalls 2043 and 2041, and lower XZ base 2051. Also shown are rigid flaps 2054A/2056A and 2054B/2056B. FIG. 3A shows YZ sidewalls 2043 and 2041, upper edges 2048 and 2048B and lower XZ base 2051.

FIG. 4 shows an XZ side elevation of the first and second part of the system of FIGS. 1 and 2, respectively, engaged in a position where the second part is fitted over the first part of the system.

Figure 5:
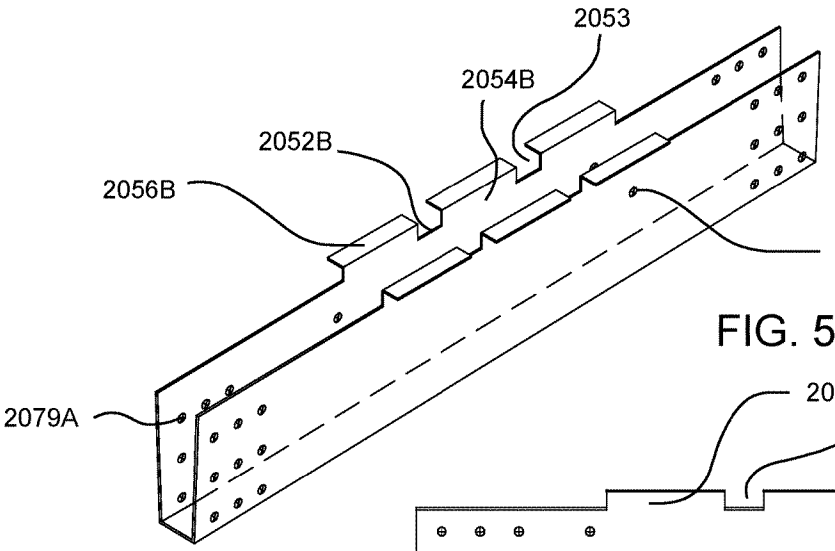
FIG. 5 is an additional perspective view of a first part of the system.

FIG. 5 is a view similar to that of FIG. 1, focusing on the series of rigid flaps 2054B/2056B, the space 2053 between them, and the lower edge 2053 of the space 2053 thereof. Said space between said rigid securement flaps may be in a range of geometric shapes, including, circular, square, dove-tail, rectangular, etc.

FIG. 6 shows a side elevation of the first part of the system, including views of rigid flaps 2054A, lower edge 2052A of the space 2053 between the rigid flaps 2054A, holes 2055, and screw areas 2079A.

FIG. 7 shows a top view of the first part of the system, including views of rigid flap lips 2056A and 2056B, lower edge 2052A of the space between the rigid flaps 2054A, as well as the lower XZ base 2051.

There is provided a second embodiment of a construction system provided in terms of an X, Y, and Z coordinate system. This is particularly shown in FIGS. 8-10.

The primary differences from the first embodiment to the second embodiment are the nature of the spacing between the rigid flaps 2053. As may be seen in the second embodiment, edges 2152A and 2152B exist at a higher elevation than 2052A and 2052B. Comparing the second embodiment to the first embodiment, i.e. FIG. 8 and FIG. 9 as compared with 5 and 6, edge 2052A/2052B of the first embodiment is of the same height as upper edges 2048 and 2048B, but in the second embodiment, edges 2152A and 2152B are slightly more elevated.

Figure 8:
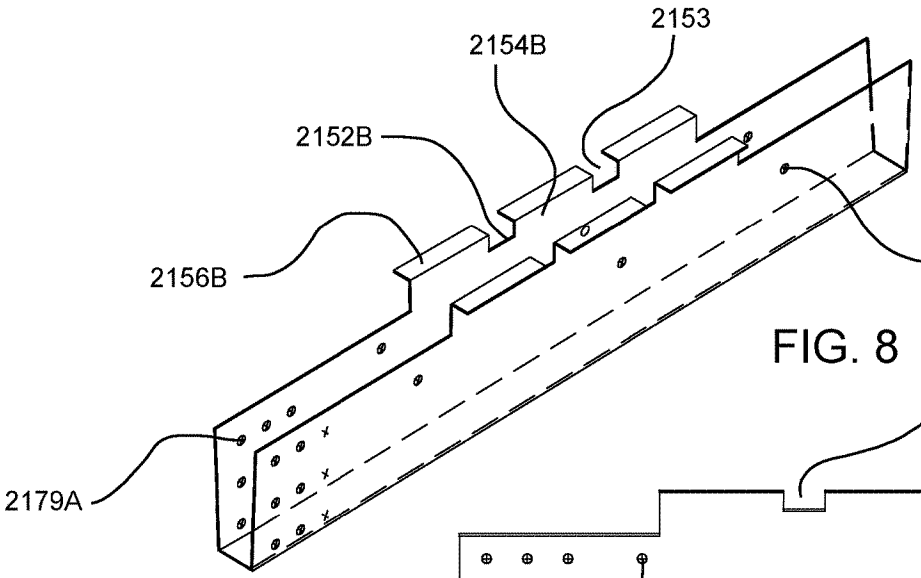
FIG. 8 is a perspective view of a second embodiment of the first part of the system.

FIG. 8 is a view similar to that of FIG. 5, focusing on the series of rigid flaps 2154B/2156B, the space 2153 between them, and the lower edge 2153 of the space 2153 thereof.

Said space between said rigid securement flaps may be in a range of geometric shapes, including, circular, square, dovetail, rectangular, etc.

Figure 9:
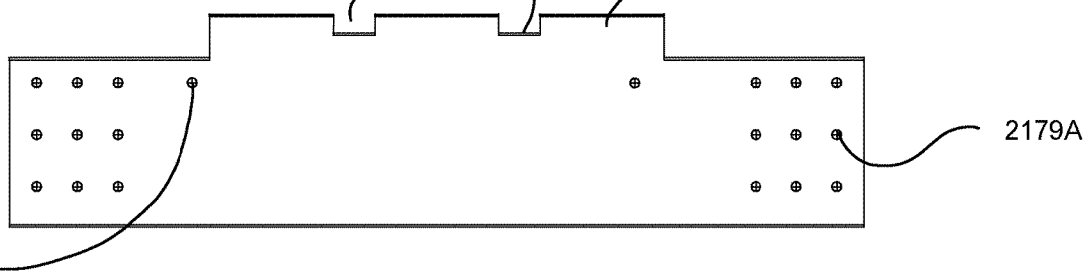
FIG. 9 is a YZ side elevation of the second embodiment of the first part of the system.

FIG. 9 shows a side elevation of the first part of the system, including views of rigid flaps 2154A, lower edge 2152A of space 2153 between rigid flaps 2154A, holes 2055, and screw areas 2079A.

Figure 10:
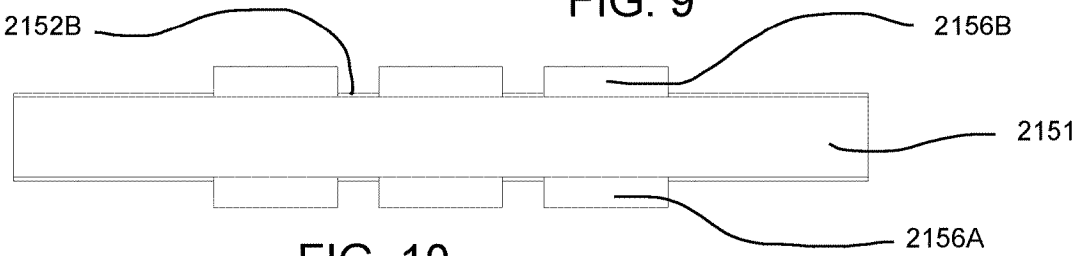
FIG. 10 is an XZ top view of the system of FIG. 8.

FIG. 10 shows a top view of the first part of the system, including views of rigid flap lips 2056A and 2056B, edge 21528, as well as the lower XZ base 2051.

Figure 11:
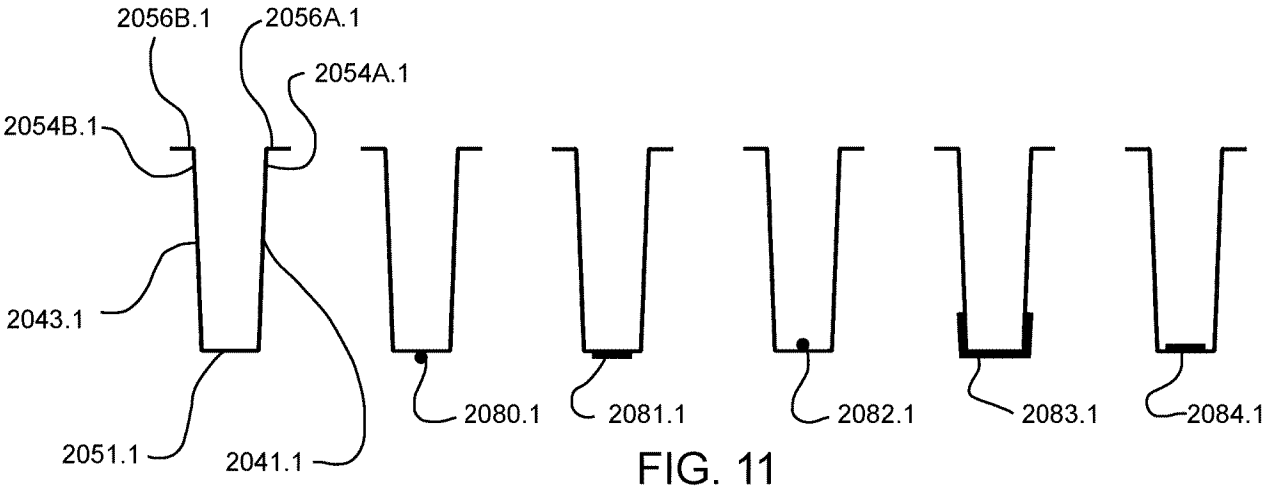
FIG. 11 show XY trapezoidal cross-sections of the system.
Figure 12:
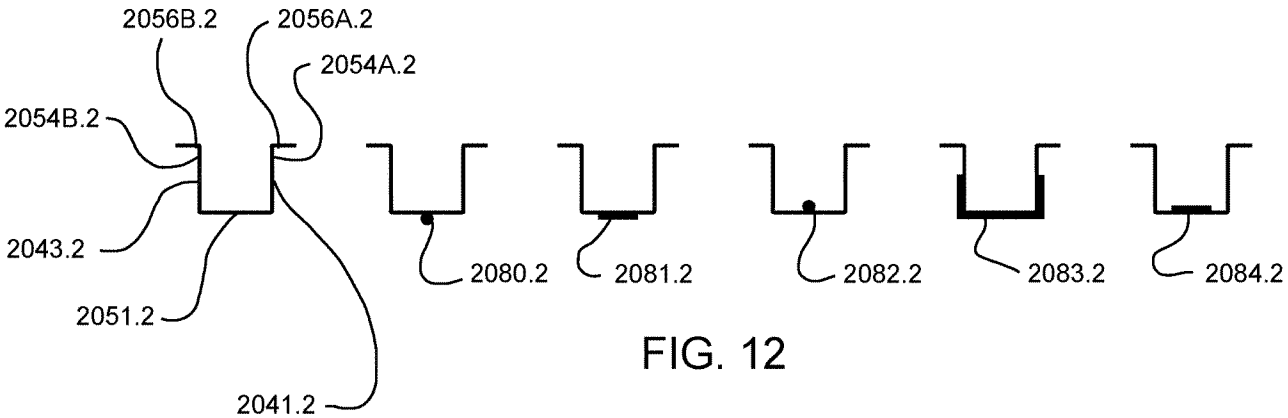
FIG. 12 shows XY square cross-sections of the system.
Figure 13:
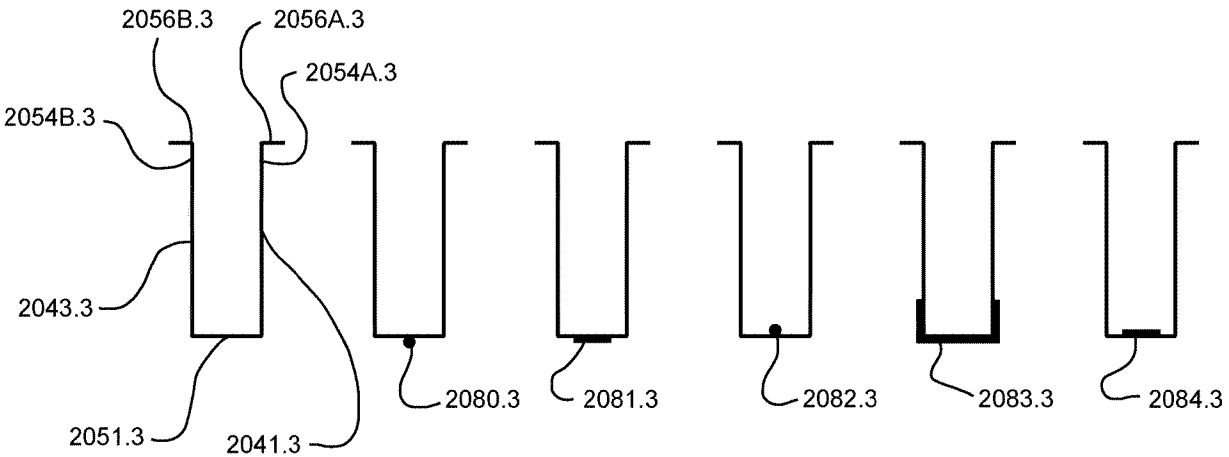
FIG. 13 shows XY rectangular cross-sections of the system.
Figure 14:
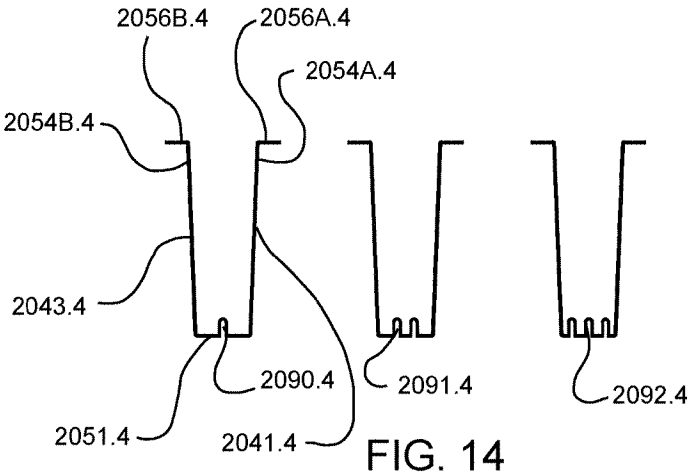
FIG. 14 shows other trapezoidal cross-sections of the system.
Figure 15:
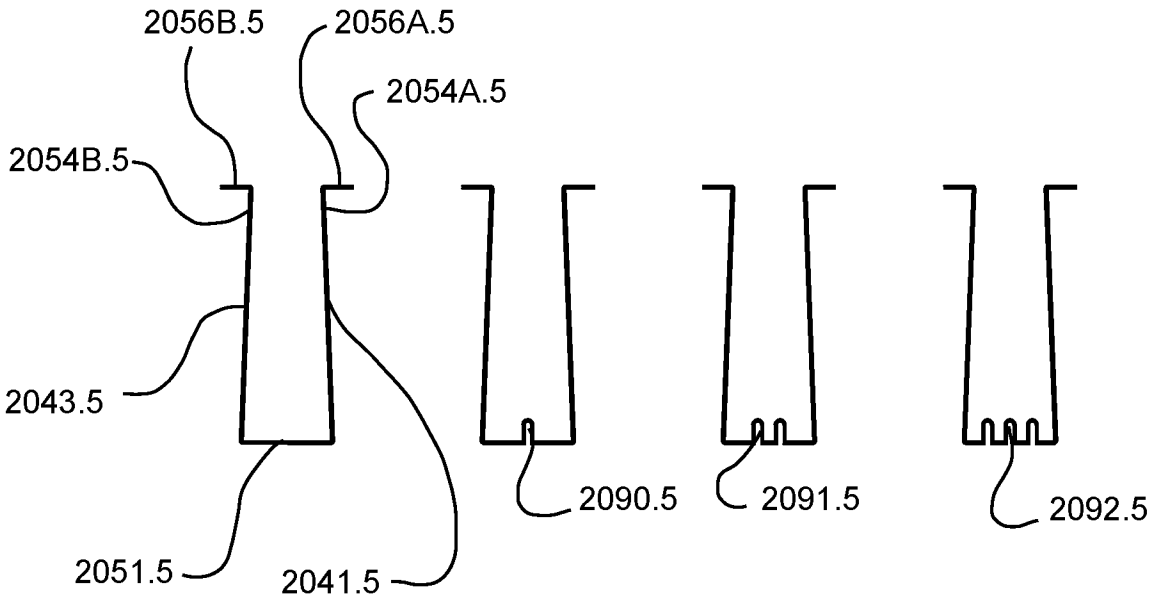
FIG. 15 shows inverted XY trapezoidal cross-sections of the system.

In FIGS. 11-15 are shown different cross sections of the three-walled members. FIG. 11 shows the XY cross-section as a trapezoid with upper XZ open plane of larger width than lower XZ base. FIG. 12 shows the XY cross-section as a square with upper open plane and lower XZ base of equal width, and right and left sides of equal width to each other as well as upper XZ plane and lower XZ base. FIG. 13 shows a XY cross-section similar to FIG. 11, but with sidewalls larger in length than in width, resembling that of a rectangle. FIG. 14 is a trapezoidal cross-section similar to FIG. 11. FIG. 15 is similar to the cross section of FIG. 14, but as an inverted trapezoid, having a lower XZ base larger than an open upper XZ plane.

Additionally shown in FIGS. 11, 12, and 13, are means for increasing the structural strength of the lower XZ base of the three-walled member. As shown in FIG. 11, element 2080.1 is a steel rod, similar to rebar, mounted directly to the bottom and elongate in the Z axis of the XZ base of the three-walled member. Similar elements 2080.2 and 2080.3 can be seen in FIGS. 12 and 13 respectively. Element 2081.1 is similar to element 2080.1, but is a steel plate elongate in the Z axis and mounted to the under-side of the lower XZ base. Element 2082.1 is a steel rod, similar to element 2080.1, but mounted to the inside lower XZ base of the three-walled member. Element 2083.1 is a u-shaped, three-walled, steel plate that is secured to the under side of the lower XZ base. Element 2084.1 is a steel plate similar to that of 2081.1, in that it is elongate in the Z axis, but is fastened to the inside lower XZ base of the three-walled member.

Each of these structural securements in FIG. 11 are present in the embodiments in FIGS. 12 and 13, that is, element 2080.1 corresponds with elements 2080.2 and 2080.3. Element 2081.1 corresponds with elements 2081.2 and 2081.3. Element 2082.1 corresponds with elements 2082.2 and 2082.3. Element 2083.1 corresponds with elements 2083.2 and 2083.3. Element 2084.1 corresponds with elements 2084.2 and 2084.3.

Shown in FIGS. 14 and 15, are different variations of ribs, elements 2090.4, 2091.4, 2092.4, 2090.5, 2091.5, 2092.5, that may be shaped within the lower XZ base of the three-walled member. These ribs offer structural securement of the member by increasing the area of the lower XZ base by giving it more surface area to distribute the stresses, which in turn gives the member a higher strength.

FIGS. 16, 17, and 18 show the system in use. FIG. 16 shows several of the three-walled members with a wire mesh 2094 over top. FIG. 17 shows a cross-section, 1-1, of the system with support pins 2080 holding up a form boards, and wire mesh 2094 over top of that. FIG. 18 shows how the cross-section will appear once the form pins and form boards are removed, exposing the concrete.

FIG. 19 further shows the system, of a first part 2040 engaging with a second part 2060 and forms a joist, which then sits on a structural support, such as a pier, beam, joist, stud, or wall. The joist forms a side elevation of a widened 'T'. The sides of the 'T' allow the joist to sit on the structural supports. In other words, the second part 2060 has elements opposite of the opening which allow the member 2060 to attach member 2040 to the structural support.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section of said first part in the form of a trapezoid with an open upper plane;

said XY cross-section of said first part having an XZ base larger in width than a lower XZ base;

a structural securing member fastened to the lower XZ base and elongate in the Z axis; and said securing member comprises a rod secured to an underside of the lower XZ base and elongate in the Z axis.

2. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section of said first part in the form of a trapezoid with an open upper plane;

said XY cross-section of said first part having an XZ base larger in width than a lower XZ base;

a structural securing member fastened to the lower XZ base and elongate in the Z axis; and said securing member comprises a rod secured to an inside surface of the lower XZ base and elongate in the Z axis.

3. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section of said first part in the form of a trapezoid with an open upper plane;

said XY cross-section of said first part having an XZ base larger in width than a lower XZ base;

a structural securing member fastened to the lower XZ base and elongate in the Z axis;

said securing member comprises a steel U-shaped plate fastened to an under side of the lower XZ base and elongate in the Z axis; and said steel U-shaped plate having a lower XZ base and two sidewalls.

4. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section of said first part comprising three straight sides and two right angles;

the XY cross-section of said first part where all angles between the sidewalls and the lower base are at a 90 degree angle;

a structural securing member fastened to a lower XZ surface and elongate in the Z axis; and said securing member comprises a rod secured to an under side of the lower XZ base and elongate in the Z axis.

5. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section of said first part comprising three straight sides and two right angles;

the XY cross-section of said first part where all angles between the sidewalls and the lower base are at a 90 degree angle;

a structural securing member fastened to a lower XZ surface and elongate in the Z axis; and said securing member comprises a rod secured to an inside surface of the lower XZ base and elongate in the Z axis.

6. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section of said first part comprising three straight sides and two right angles;

the XY cross-section of said first part where all angles between the sidewalls and the lower base are at a 90 degree angle;

a structural securing member fastened to a lower XZ surface and elongate in the Z axis;

said securing member comprises a steel U-shaped plate fastened to an under side of the lower XZ base and elongate in the Z axis; and said steel U-shaped plate having a lower XZ base and two sidewalls.

7. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section in the form of an inverted trapezoid with an open upper plane;

said XY cross-section having said open upper plane lesser in width than a lower XZ base;

said trapezoidal cross-section having YZ webs greater in height dimensions to that of the width dimensions of the open upper plane and lower XZ base;

a structural securing member fastened to the lower XZ base and elongate in the Z axis; and said securing member comprises a rod secured to an under side of the lower XZ base and elongate in the Z axis.

8. A construction system definable in terms of an X, Y, and Z coordinate axes structure, the system comprising:

a first part having a hollow three-walled web elongate in the Z axis, having a series of rigid securement flaps on the upper edges of the elongate Z axis member;

a second part having at least one open end for complemental engagement of the first part wherein the second part is adapted to fit over distal ends of said first part in which a cross-section of the second part is that of the first part, but wide and tall enough to allow the first part to slip within the second part, and said second part having an opposite end of said opening, wherein said second part securing the first part to a structural support;

said first part having a hollow three-walled web having an open upper XZ area and a lower XZ base along an elongate Z axis connected to two opposing walls of YZ planes;

said series of rigid securement rigid flaps extending upwardly in a positive Y direction from said open upper XZ area;

rigid securement flaps of said series of rigid securement flaps extending upwardly from a first wall of said three-walled web having a cross-section in the YX plane resembling an inverted "L", wherein the lip of the "L" extends away from the direction of the X center of the member on the X axis;

rigid securement flaps of said series of rigid securement flaps extending upwardly from an opposing wall of said first wall of said three-walled web having a cross-section in the YX plane resembling a mirror of an inverted "L", wherein the lip of the "L" extends away the direction of the X center of the member on the X axis;

said series of rigid securement flaps having a YZ space between each flap;

an XY cross-section in the form of an inverted trapezoid with an open upper plane;

said trapezoidal cross-section having said open upper plane lesser in width than a lower XZ base;

said XY cross-section having YZ webs greater in height dimensions to that of the width dimensions of the open upper plane and lower XZ base;

a structural securing member fastened to the lower XZ base and elongate in the Z axis; and said securing member comprises a rod secured to an inside surface of the lower XZ base and elongate in the Z axis.

* * * * *